US012679620B2

(12) United States Patent
Perell

(10) Patent No.: US 12,679,620 B2
(45) Date of Patent: Jul. 14, 2026

(54) EASY TO OPEN PACKAGE WITH CONTROLLED DISPENSING DEVICE

(71) Applicant: PopPack LLC, San Francisco, CA (US)

(72) Inventor: Williams S. Perell, San Francisco, CA (US)

(73) Assignee: PopPack, LLC, San Francisco, CA (US)

( * ) Notice: Subject to any disclaimer, the term of this patent is extended or adjusted under 35 U.S.C. 154(b) by 0 days.

(21) Appl. No.: 17/859,729

(22) Filed: Jul. 7, 2022

(65) Prior Publication Data

US 2022/0340350 A1 Oct. 27, 2022

Related U.S. Application Data

(63) Continuation of application No. 16/801,932, filed on Feb. 26, 2020, now Pat. No. 11,383,909.

(60) Provisional application No. 62/811,222, filed on Feb. 27, 2019.

(51) Int. Cl.

| | |
|---|---|
| ***B65D 77/38*** | (2006.01) |
| ***B65D 33/00*** | (2006.01) |
| ***B65D 75/58*** | (2006.01) |

(52) U.S. Cl.

CPC ..... *B65D 77/38* (2013.01); *B65D 33/00* (2013.01); *B65D 75/5855* (2013.01); *B65D 75/5866* (2013.01); *B65D 2575/3245* (2013.01)

(58) Field of Classification Search

CPC .... B65D 77/38; B65D 33/00; B65D 75/5855; B65D 75/5866

See application file for complete search history.

(56) References Cited

U.S. PATENT DOCUMENTS

| | | | |
|---|---|---|---|
| 2,325,921 | A | 8/1943 | Salfisberg |
| 2,333,587 | A | 11/1943 | Salfisberg |
| RE24,251 | E | 12/1956 | Kaplan et al. |
| 2,916,886 | A | 12/1959 | Robbins |
| 3,074,544 | A | 1/1963 | Bollmeier et al. |
| 3,120,336 | A | 2/1964 | Whatley, Jr. |
| 3,189,227 | A | 6/1965 | Hobbs et al. |
| 3,217,871 | A | 11/1965 | Lee |
| 3,256,981 | A | 6/1966 | Kurtz |
| 3,294,227 | A | 12/1966 | Schneider et al. |
| 3,301,390 | A | 1/1967 | Via, Jr. |

(Continued)

FOREIGN PATENT DOCUMENTS

| | | |
|---|---|---|
| DE | 20314741 U1 | 1/2004 |
| EP | 0709302 A1 | 5/1996 |

(Continued)

*Primary Examiner* — Derek J Battisti

(74) *Attorney, Agent, or Firm* — Dority & Manning, P.A.

(57) ABSTRACT

A package or container is disclosed that includes an opening device in conjunction with a self-sealing valve for facilitating opening of the package and for dispensing fluids in a controlled manner. In one embodiment, the opening device can comprise a breachable bubble. The breachable bubble can be in communication with a fluid channel that operates in conjunction with the self-sealing valve. The package can include a folded portion for sealing the fluid channel and allowing the bubble to be breached when a user applies pressure. Once the bubble is breached, the folded portion can be unfolded for dispensing a fluid.

12 Claims, 7 Drawing Sheets

(56) References Cited

U.S. PATENT DOCUMENTS

| | | | |
|---|---|---|---|
| 3,325,575 | A | 6/1967 | Last |
| 3,342,326 | A | 9/1967 | Zackheim |
| 3,419,137 | A | 12/1968 | Walck, III |
| 3,430,842 | A | 3/1969 | Yamaguchi |
| 3,466,356 | A | 9/1969 | Zavitz |
| 3,478,871 | A | 11/1969 | Sager |
| 3,573,069 | A | 3/1971 | Keller et al. |
| 3,608,709 | A | 9/1971 | Pike |
| 3,608,815 | A | 9/1971 | Bunch |
| 3,635,376 | A | 1/1972 | Hellstrom |
| 3,835,995 | A | 9/1974 | Haines |
| 3,847,279 | A | 11/1974 | Montgomery |
| 3,859,859 | A | 1/1975 | White |
| 3,921,805 | A | 11/1975 | Compere |
| 3,938,659 | A | 2/1976 | Wardwell |
| 3,960,997 | A | 6/1976 | Sorensen |
| 3,964,604 | A | 6/1976 | Prenntzell |
| 4,069,645 | A | 1/1978 | Vetter |
| 4,196,809 | A | 4/1980 | Tonrey |
| 4,275,840 | A | 6/1981 | Staar |
| 4,301,923 | A | 11/1981 | Vuorento |
| 4,375,383 | A | 3/1983 | Sewell et al. |
| 4,402,402 | A | 9/1983 | Pike |
| 4,442,259 | A | 4/1984 | Isgur et al. |
| 4,485,920 | A | 12/1984 | Skylvik |
| 4,488,647 | A | 12/1984 | Davis |
| 4,511,052 | A | 4/1985 | Klein et al. |
| D279,808 | S | 7/1985 | Pharo |
| 4,540,089 | A | 9/1985 | Maloney |
| 4,597,244 | A | 7/1986 | Pharo |
| 4,610,684 | A | 9/1986 | Knox et al. |
| 4,632,244 | A | 12/1986 | Landau |
| 4,691,373 | A | 9/1987 | Ausnit |
| 4,704,314 | A | 11/1987 | Hsu et al. |
| 4,708,167 | A | 11/1987 | Koyanagi |
| 4,711,359 | A | 12/1987 | White et al. |
| 4,759,472 | A | 7/1988 | Strenger |
| 4,793,123 | A | 12/1988 | Pharo |
| 4,798,288 | A | 1/1989 | Holzner |
| 4,805,767 | A | 2/1989 | Newman |
| 4,859,521 | A | 8/1989 | Pike et al. |
| 4,872,556 | A | 10/1989 | Farmer |
| 4,872,558 | A | 10/1989 | Pharo |
| 4,874,093 | A | 10/1989 | Pharo |
| 4,889,884 | A | 12/1989 | Dust et al. |
| 4,890,744 | A | 1/1990 | Lane, Jr. et al. |
| 4,898,280 | A | 2/1990 | Runge |
| 4,902,370 | A | 2/1990 | Dust et al. |
| 4,904,092 | A | 2/1990 | Campbell et al. |
| 4,917,675 | A | 4/1990 | Taylor et al. |
| 4,918,904 | A | 4/1990 | Pharo |
| 4,949,530 | A | 8/1990 | Pharo |
| 4,961,495 | A | 10/1990 | Yoshida et al. |
| 5,050,736 | A | 9/1991 | Griesbach |
| 5,100,028 | A | 3/1992 | Siefert |
| 5,114,004 | A | 5/1992 | Isono et al. |
| 5,126,070 | A | 6/1992 | Leifheit et al. |
| 5,131,760 | A | 7/1992 | Farmer |
| 5,137,154 | A | 8/1992 | Cohen |
| 5,195,658 | A | 3/1993 | Hoshino |
| 5,207,320 | A | 5/1993 | Allen |
| 5,215,221 | A | 6/1993 | Dirksing |
| 5,272,856 | A | 12/1993 | Pharo |
| 5,325,968 | A | 7/1994 | Sowden |
| 5,330,269 | A | 7/1994 | Kamada et al. |
| 5,347,400 | A | 9/1994 | Hunter |
| 5,352,466 | A | 10/1994 | Delonis |
| 5,373,966 | A | 12/1994 | O'Reilly et al. |
| 5,419,638 | A | 5/1995 | Jamison |
| 5,427,830 | A | 6/1995 | Pharo |
| 5,445,274 | A | 8/1995 | Pharo |
| 5,447,235 | A | 9/1995 | Pharo |
| 5,487,470 | A | 1/1996 | Pharo |
| 5,492,219 | A | 2/1996 | Stupar |
| 5,538,345 | A | 7/1996 | Gotoh et al. |
| 5,564,591 | A | 10/1996 | Christine |
| 5,588,532 | A | 12/1996 | Pharo |
| 5,616,337 | A | 4/1997 | Kasianovitz et al. |
| 5,616,400 | A | 4/1997 | Zhang |
| 5,631,068 | A | 5/1997 | Smith |
| D386,074 | S | 11/1997 | Pharo |
| 5,691,015 | A | 11/1997 | Tsukamoto et al. |
| 5,701,996 | A | 12/1997 | Goto et al. |
| 5,711,691 | A | 1/1998 | Damask et al. |
| 5,775,491 | A | 7/1998 | Taniyama |
| 5,792,213 | A | 8/1998 | Bowen |
| 5,814,159 | A | 9/1998 | Paley et al. |
| 5,824,392 | A | 10/1998 | Gothoh |
| 5,865,309 | A | 2/1999 | Futagawa et al. |
| 5,870,884 | A | 2/1999 | Pike |
| 5,910,138 | A | 6/1999 | Sperko et al. |
| 5,928,213 | A | 7/1999 | Barney et al. |
| 5,944,709 | A | 8/1999 | Barney et al. |
| 5,967,308 | A | 10/1999 | Bowen |
| 6,001,187 | A | 12/1999 | Paley et al. |
| 6,007,264 | A | 12/1999 | Koptis |
| 6,036,004 | A | 3/2000 | Bowen |
| 6,068,820 | A | 5/2000 | De Guzman |
| 6,073,767 | A | 6/2000 | Cohen et al. |
| 6,131,736 | A | 10/2000 | Faris et al. |
| 6,152,601 | A | 11/2000 | Johnson |
| 6,165,161 | A | 12/2000 | York et al. |
| 6,198,106 | B1 | 3/2001 | Barney et al. |
| 6,203,535 | B1 | 3/2001 | Barney et al. |
| 6,244,746 | B1 | 6/2001 | Tokita et al. |
| 6,273,609 | B1 | 8/2001 | Johnson |
| 6,280,085 | B1 | 8/2001 | Beer |
| 6,290,801 | B1 | 9/2001 | Tonrey |
| 6,436,500 | B1 | 8/2002 | Yingst et al. |
| 6,468,377 | B1 | 10/2002 | Sperko et al. |
| 6,491,159 | B2 | 12/2002 | Yukihiko |
| 6,505,383 | B2 | 1/2003 | Machacek et al. |
| 6,547,468 | B2 | 4/2003 | Gruenbacher et al. |
| 6,658,400 | B2 | 12/2003 | Perell et al. |
| 6,692,150 | B2 | 2/2004 | Hoshino |
| 6,726,364 | B2 | 4/2004 | Perell et al. |
| 6,846,305 | B2 | 1/2005 | Smith et al. |
| 6,935,492 | B1 | 8/2005 | Loeb |
| 6,938,394 | B2 | 9/2005 | Perell |
| 6,968,952 | B2 | 11/2005 | Crevier et al. |
| 6,996,951 | B2 | 2/2006 | Smith et al. |
| 7,004,354 | B2 | 2/2006 | Harper |
| 7,040,483 | B2 | 5/2006 | Inuzuka et al. |
| 7,051,879 | B2 | 5/2006 | Ramet |
| 7,055,683 | B2 | 6/2006 | Bourque et al. |
| 7,172,220 | B2 | 2/2007 | Franko, Sr. |
| 7,175,614 | B2 | 2/2007 | Gollier et al. |
| 7,300,207 | B2 | 11/2007 | Linneweil |
| 7,306,095 | B1 | 12/2007 | Bourque et al. |
| 7,306,371 | B2 | 12/2007 | Perell |
| 7,371,008 | B2 | 5/2008 | Bonenfant |
| 7,597,691 | B2 | 10/2009 | Kawaguchi et al. |
| 7,644,821 | B2 | 1/2010 | Perell |
| 7,669,736 | B2 | 3/2010 | Harper |
| RE41,273 | E | 4/2010 | Perell |
| 7,712,962 | B1 | 5/2010 | Reuhs et al. |
| 7,757,893 | B2 | 7/2010 | Perell |
| 7,963,201 | B2 | 6/2011 | Willoughby et al. |
| 8,328,017 | B2 | 12/2012 | Perell |
| 8,590,282 | B2 | 11/2013 | Perell |
| 8,684,601 | B2 | 4/2014 | Perell |
| 8,784,915 | B2 | 7/2014 | Evers |
| 9,802,745 | B2 * | 10/2017 | Perell ..... B65D 75/5866 |
| 9,981,792 | B2 | 5/2018 | Eberhardt et al. |
| 2002/0150658 | A1 | 10/2002 | Morrissette et al. |
| 2002/0170832 | A1 | 11/2002 | Klair |
| 2003/0019781 | A1 | 1/2003 | Kocher |
| 2003/0102229 | A1 | 6/2003 | Inzuka et al. |
| 2003/0113519 | A1 | 6/2003 | Wasserman et al. |
| 2004/0057638 | A1 | 3/2004 | Perell |
| 2004/0141664 | A1 | 7/2004 | Olsen et al. |
| 2004/0226848 | A1 | 11/2004 | Dunn/Rankin |
| 2004/0231292 | A1 | 11/2004 | Perell |
| 2005/0137073 | A1 | 6/2005 | Weaver |

(56) References Cited

U.S. PATENT DOCUMENTS

2005/0286811 A1 12/2005 Sprague et al.
2006/0023976 A1 2/2006 Alvater et al.
2006/0126970 A1 6/2006 Perell
2006/0182370 A1* 8/2006 Risgalla ..... B65D 75/5866 383/44
2007/0140597 A1 6/2007 Ozdeger Donovan et al.
2007/0235357 A1 10/2007 Perell
2007/0235369 A1 10/2007 Perell
2007/0237431 A1* 10/2007 Perell ..... B65D 75/30 383/3
2007/0241024 A1 10/2007 Perell
2007/0284375 A1 12/2007 Perell
2007/0286535 A1 12/2007 Perell
2007/0295766 A1* 12/2007 Perell ..... B65D 75/5855 222/1
2008/0050055 A1 2/2008 Austreng et al.
2008/0212904 A1 9/2008 Perell
2008/0223875 A1* 9/2008 LaFlamme ..... B05B 11/1032 222/207
2009/0196534 A1 8/2009 Song et al.
2009/0226121 A1 9/2009 Veder
2010/0008602 A1 1/2010 Risgalla
2010/0150481 A1* 6/2010 Perell ..... B65D 75/566 283/56
2010/0278462 A1 11/2010 Sorensen
2010/0300901 A1 12/2010 Perell
2011/0158564 A1 6/2011 Krumme
2011/0192736 A1 8/2011 Perell
2011/0200275 A1* 8/2011 Perell ..... B31B 70/00 493/210
2013/0118134 A1* 5/2013 Perell ..... B65B 47/02 493/212
2019/0077563 A1 3/2019 Roesler et al.
2019/0161217 A1 5/2019 Perell

FOREIGN PATENT DOCUMENTS

FR 2345363 A1 10/1977
FR 2910884 A1 1/2007
JP H04215927 A 8/1992
JP H078236 U 2/1995
JP H1129176 A 2/1999
JP H11301709 A 11/1999
JP 2000255598 A 9/2000
JP 2002503187 A 1/2002
JP 2002037327 A 2/2002
JP 2003146364 A 5/2003
WO WO1994007761 A1 4/1994
WO WO2009/088759 A1 7/2009
WO WO2009086344 A1 7/2009
WO WO2009086346 A1 7/2009

* cited by examiner

EASY TO OPEN PACKAGE WITH CONTROLLED DISPENSING DEVICE

RELATED APPLICATIONS

The present application is based on and claims priority to U.S. patent application Ser. No. 16/801,932, filed on Feb. 26, 2020 and which is based on and claims priority to U.S. Provisional Patent Application Ser. No. 62/811,222, filed on Feb. 27, 2019, both of which are incorporated herein by reference.

BACKGROUND

Currently, many liquid products are packaged in flexible containers. The flexible containers, for instance, can be made from one or more layers of polymer film. Packages made from polymer films can offer various advantages. For instance, the polymer films can be wrapped tightly around the products for eliminating void space. The resulting packages are not very bulky and are easy to handle. The polymer films can sometimes be translucent, allowing a purchaser to view the contents prior to making the purchase. In addition, the polymer films can be printed with decorative graphics to make the product more attractive.

Although packages made from polymer films can provide various advantages, opening such packages can be quite difficult. For example, the polymer films must have sufficient strength to prevent against rupture during the packaging process and during subsequent transportation. Increasing the strength of the film or the seals that surround the content of the package, however, often increases the difficulty in opening the package. For example, many such packages, such as packages that contain liquid products, do not include an easy opening feature. Thus, brute force, scissors, a knife, or another suitable instrument need to be used in order to open the package.

In view of the above, those skilled in the art have attempted to improve the manner in which packages and containers are opened. For instance, PopPack, Inc. has made many significant and meritorious advances in the design and construction of packages and particularly in the design of techniques and methods for opening packages and containers. Examples of opening devices for packages are disclosed in, for example, U.S. Pat. No. 6,726,364 to Perell et al., U.S. Pat. No. 6,938,394 to Perell, U.S. Pat. No. 7,306,371 to Perell, U.S. Pat. No. 7,644,821 to Perell, U.S. Pat. No. RE 41,273 to Perell, U.S. Patent Appl. Pub. No. 20080212904 to Perell, U.S. Patent Appl. Pub. No. 20070295766 to Perell, U.S. Patent Appl. Pub. No. 20070286535 to Perell, U.S. Patent Appl. Pub. No. 20070284375 to Perell, U.S. Patent Appl. Pub. No. 20070241024 to Perell, U.S. Patent Appl. Pub. No. 20070237431 to Perell, U.S. Patent Appl. Pub. No. 20070235369 to Perell, U.S. Patent Appl. Pub. No. 20070235357 to Perell, U.S. Patent Appl. Pub. No. 20060126970 to Perell, U.S. Patent Appl. Pub. No. 20040231292 to Perell, and U.S. Patent Appl. Pub. No. 20040057638 to Perell et al. The subject matter of each of the above-referenced issued patents and published applications is fully incorporated herein by reference.

Another problem with such previously made containers is that it is typically difficult to dispense the fluid in a controlled manner. These containers, for instance, are opened by tearing the top off the container, tearing a corner or inserting a straw into the container. Since the packages are flexible, the containers are prone to spill their contents, especially when any type of pressure is applied to the container. Once open, and in the absence of a separate rigid pouring valve welded or glued to the container or otherwise affixed, these receptacles cannot be re-closed easily, and tend to allow the liquid to escape. The user is therefore obliged to hold the receptacle once it has been opened, since it cannot be placed on a table or other surface before it has been completely emptied, in order to avoid accidental leaks.

In view of the above, the present disclosure is generally directed to an improved container that is relatively easy to open and has a built-in pour channel for dispensing compositions from the container in a controlled manner without being prone to accidental spillage.

SUMMARY

In general, the present disclosure is directed to a package for holding and dispensing compositions, such as fluids. The package, for instance, can hold liquid products, such as beverages, liquid soaps and detergents, hair care products, sunscreen compositions, and the like.

In one embodiment, the package comprises a flexible container defining an interior volume for receiving a fluid. The flexible container may be comprised of a flexible polymer film. The package further comprises a fluid channel including a first end and an opposite second end. The fluid channel is in communication with a fluid outlet at the first end and is connected to the interior volume of the flexible container at the second end. A self-sealing valve is positioned at the second end of the fluid channel.

A folded portion of the flexible container is located along the perimeter of the flexible container. The folded portion lays against an exterior surface of the flexible container and intersects with the fluid channel to block fluid flow through the channel. In one embodiment, the folded portion of the flexible container comprises a folded corner of the flexible container and the folded corner forms an obtuse angle with the top edge of the flexible container.

A breachable bubble is located on the folded portion extending in a direction opposite the exterior surface of the flexible container. The breachable bubble surrounds the fluid outlet such that fluids flowing through the fluid outlet are prevented from exiting the flexible container. When the bubble is breached, fluid communication is established between the fluid outlet and the ambient. In one embodiment, the breachable bubble is formed with a bubble seal that is formed around the first end of the fluid channel such that the fluid channel resides within the breachable bubble and is in fluid communication with the breachable bubble. The bubble seal may contain a weakened portion in order to influence the breaching point to the opposite side from the fold line.

Unfolding the folded portion after the bubble is breached allows fluid to be dispensed from the interior volume through the self-sealing valve and fluid channel when pressure is applied to the flexible container. In one embodiment, the breachable bubble has a reclosable attachment in order to close the bubble after it is breached.

In one embodiment, the self-sealing valve is formed by forming a barrier member by attaching opposing container walls together. The barrier is located adjacent to the second end of the fluid channel so that at least one valve-like passageway is formed between the second end of the fluid channel and the interior volume of the container. When the package is filled, the shape of the barrier member causes folds in the container that prevent fluid flow through the valve-like passageway absent external pressure. In another embodiment, the package comprises two barrier members with a valve-like passageway therebetween that connects the fluid channel to the interior volume of the container.

Also disclosed is a method for opening the package. First, pressure is applied to the breachable bubble causing the breachable bubble to breach and thereby exposing the fluid outlet to the ambient. The package is then unfolded. Then, by applying pressure to the flexible container, a fluid product contained within the interior volume exits the flexible container through the self-sealing valve and the fluid outlet.

Further aspects and features of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
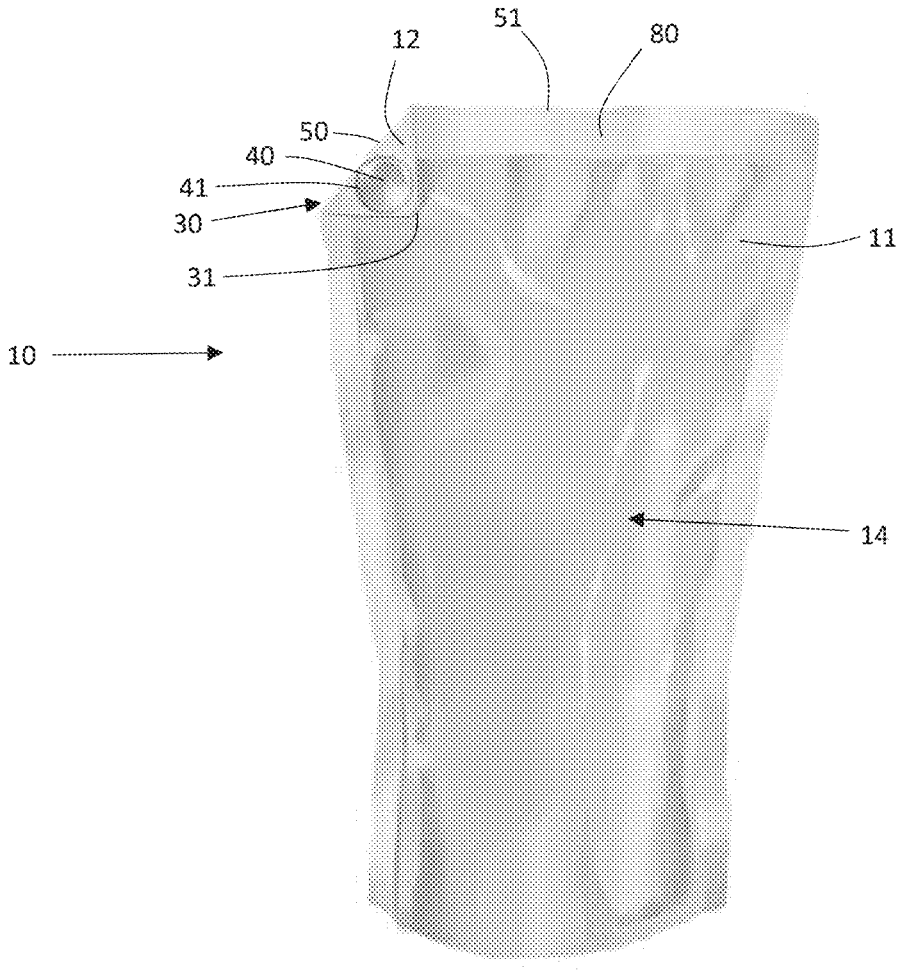
FIG. 1 shows one embodiment of the package with the folded portion in the folded position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present disclosure is directed to a package for holding and dispensing liquid compositions that includes a self-sealing valve. In accordance with the present disclosure, the package comprises a fluid channel connected to a fluid outlet at a first end and to the interior volume of the package at a second end. The self-sealing valve is positioned at the second end of the fluid channel. A method for opening the package is also disclosed.

The package, in one embodiment, can be made from one or more layers of a polymer film. The walls of the package, for example, can be flexible. In the past, such packages have been relatively difficult to open. In this regard, the present disclosure is directed to a package that is not only easy to open but that can also dispense fluids in a precise and controlled manner that prevents accidental spills. In accordance with the present disclosure, the package includes a breachable bubble to facilitate opening of the package in combination with a self-sealing valve that is configured to dispense fluids in a controlled manner. Sufficient fluid may be trapped within the breachable bubble that the bubble may breach upon application of pressure by a user. Breaching of the bubble can cause various sealed portions of the layers of film to separate.

The bubble is located on a folded portion of the package. When the folded portion is in a folded position, the bubble is effectively sealed from the interior volume of the package to facilitate breaching. However, upon breaching of the bubble and when the folded portion is in the unfolded position, the contents of the interior volume of the package may be dispensed through the fluid channel and the fluid outlet upon pressure exerted on the package by a user. If no pressure is provided by a user, then the self-sealing valve prevents the contents of the package from escaping. As such, the package provides an easy to open package which can be made simply and inexpensively, which prevents unwanted spilling of its contents.

Referring to FIG. 1, reference numeral 10 generally indicates a package in accordance with one embodiment of the present invention. The package 10 may include a first film 11 and a second film 12. The first film 11 and second film 12 may, in general, be flexible polymer films. In one embodiment of the present invention, the first film 11 and the second film 12 may be portions of a singular sheet of flexible polymer film. In another embodiment, the first film 11 and the second film 12 may be separate sheets of flexible polymer film. It should be understood that the package 10 can have any suitable shape depending upon various factors including the type of product contained in or to be received in the package.

The first film 11 and the second film 12 can be made from any suitable polymer. Polymers that may be used to form the package include, for instance, polyolefins such as polyethylene and polypropylene, polyesters, polyamides, polyvinyl chloride, mixtures thereof, copolymers thereof, terpolymers thereof, and the like. In addition, the package can also be made from any suitable elastomeric polymer. It should be understood, however, that the first film 11 and the second film 12 are not limited to flexible polymer films, but may be any suitable films. For example, the first film 11 and second film 12 may be formed from a metallized film, laminated paper, or the like.

The first film 11 and the second film 12 can each comprise a single layer of material or can comprise multiple layers. For instance, the first film 11 and the second film 12 can each include a core layer of polymeric material coated on one or both sides with other functional polymeric layers. The other functional polymeric layers may include, for instance, an oxygen barrier layer, an ultraviolet filter layer, an anti-blocking layer, a printed layer, and the like.

The first film 11 and the second film 12 can each be translucent or transparent. If translucent or transparent, for instance, the contents of the package 10 can be viewed from the outside. In another embodiment, however, the first film 11 and the second film 12 can each be opaque. For instance, in one embodiment, the package 10 can display various graphics that identify, for instance, the brand and the description of the product inside, or that display coupons or various other indicia. In other embodiments, the first film 11 can be translucent or transparent while the second film 12 is opaque, and the first film 11 can be opaque while the second film 12 is translucent or transparent.

In accordance with the present disclosure, the first film 11 and the second film 12 may be sealed together to form a flexible container 14. The first film 11 and the second film 12 may be sealed or welded together using any suitable sealing technique, such as an adhesive.

Figure 2:
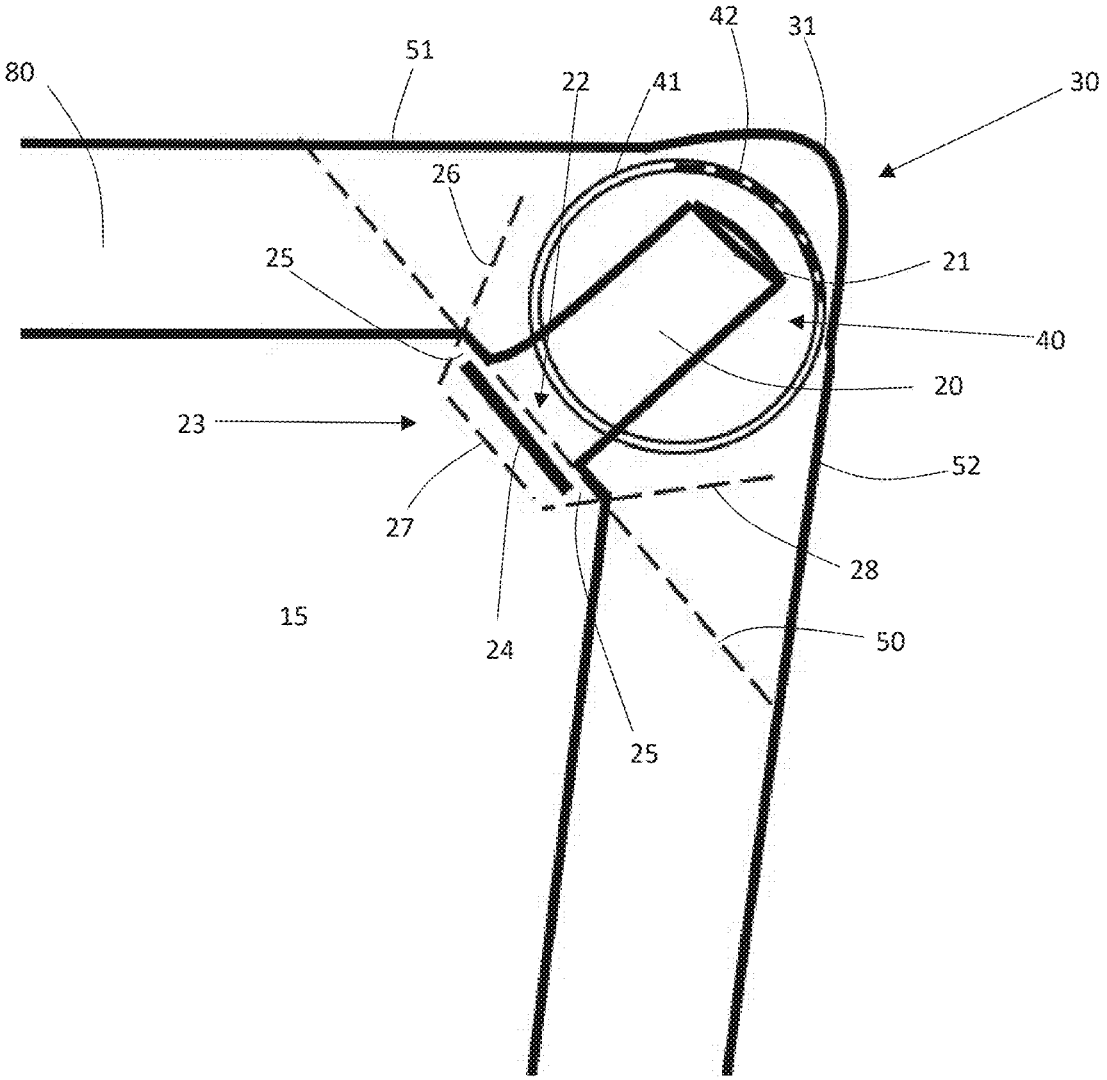
FIG. 2 shows a plan view of a corner of one embodiment of the package, showing the folded portion in the unfolded position.
Figure 7:
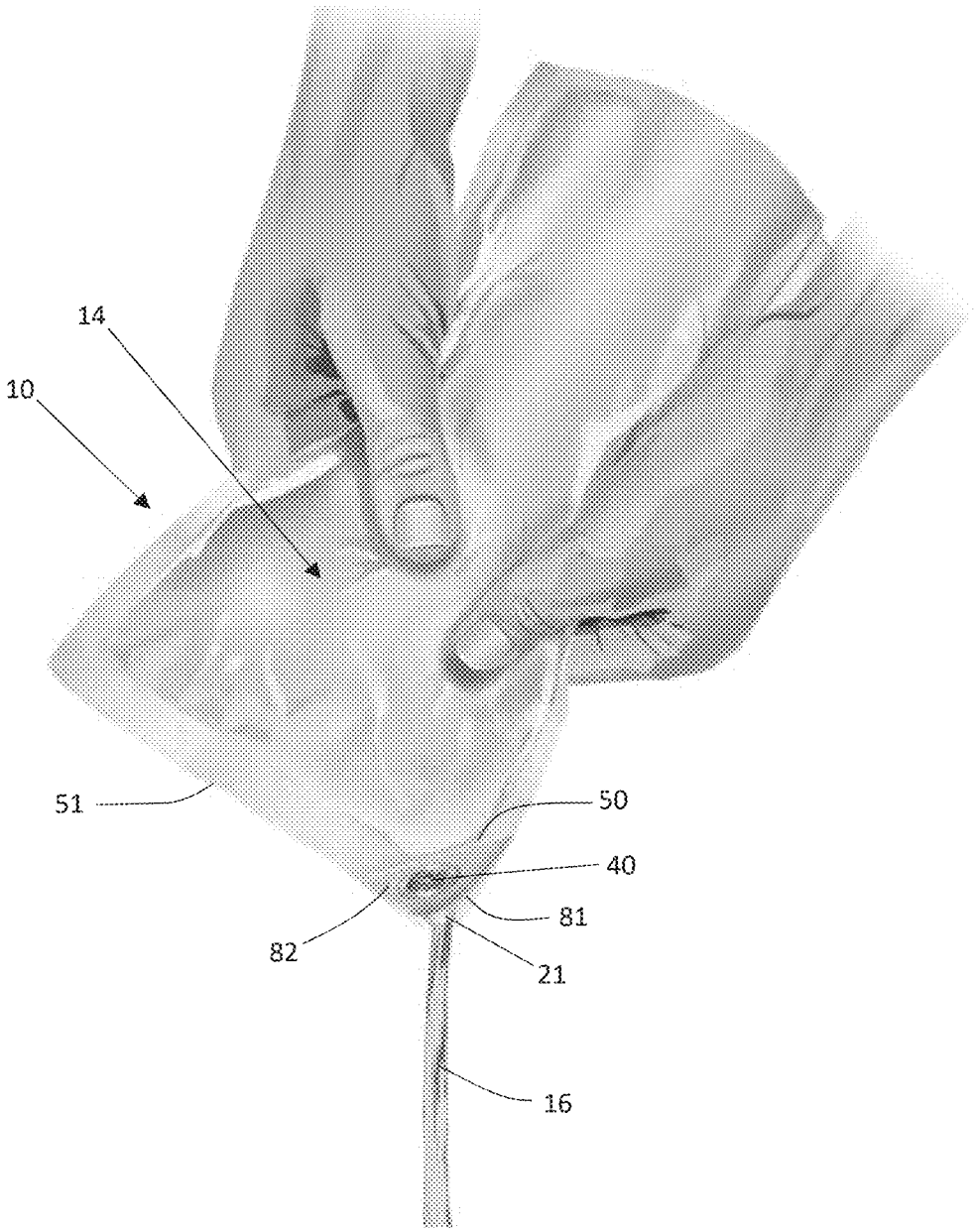
FIG. 7 shows one embodiment of the package as a user applies pressure to the package in order to dispense the contents of the package.

The flexible container 14 may define an interior volume 15, shown in FIG. 2, configured to receive a product 16, shown in FIG. 7. The portion of the first film 11 and the second film 12 which lies outside the perimeter of the sealed interior volume 15 may define a package periphery 80. In one embodiment, a product 16 may be situated in the interior volume 15. The product 16 may, in some embodiments, be a consumer product. In one embodiment, for example, the product 16 may include a beverage, a gel, a cream, a paste, a syrup, a honey, an oil, a sauce, a lubricant, or a grease. In some embodiments, the product 16 may include an emulsion, such as a mayonnaise. In some embodiments, the product 16 may include a liquid, such as a beverage.

Figure 3:
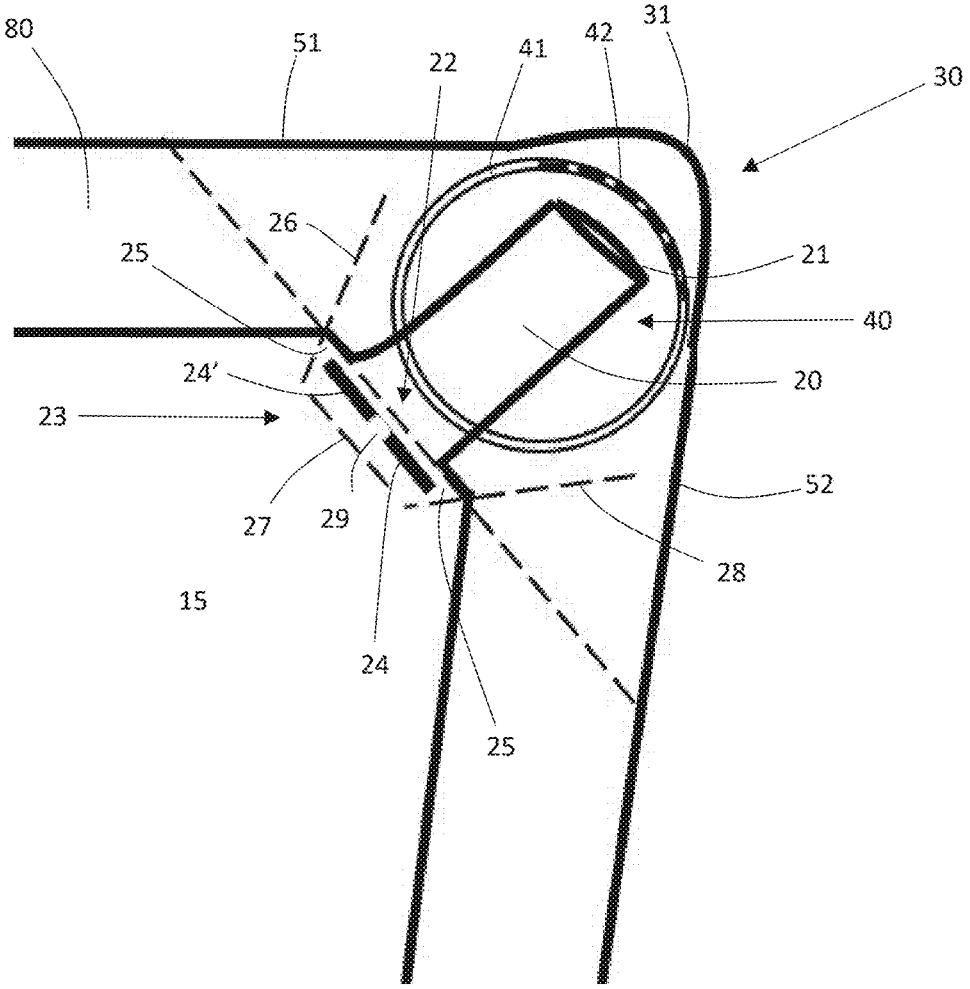
FIG. 3 shows a plan view of a corner of another embodiment of the package, showing the folded portion in the unfolded position.

As best shown in FIGS. 2 and 3, the package contains a fluid channel 20. The fluid channel 20 is connected to a fluid outlet 21 at a first end and to the interior volume 15 of the flexible container 14 at a second end 22. A self-sealing valve 23 is positioned at the second end 22 of the fluid channel 20 to prevent undesired spillage of the product 16.

In one embodiment, the self-sealing valve 23 comprises a barrier 24, as shown in FIGS. 2 and 3. The barrier may be formed by welding or gluing the first flexible film 11 and the second flexible film 12 together at a location near the second end 22 of the fluid channel 20. The barrier 24 is preferably elongate in shape and is traverse to the second end 22 of the fluid channel 20. In one embodiment, as shown in FIG. 2, the barrier 24 has a length greater than the width of the fluid channel 20. Preferably the length of the barrier is only slightly longer than the width of the fluid channel, such as form about 1 mm to about 10 mm longer. This creates at least one valve-like passageway 25 between the barrier 24 and an edge of the fluid channel 20. The barrier 24 may allow a valve-like passageway 25 on each side of the fluid channel 20 as shown in FIG. 2 or may extend all the way to the package periphery 80 on one side, only allowing a single valve-like passageway between the interior volume 15 and the fluid channel 20. Preferably, the elongate barrier extends approximately perpendicular to the general direction of the fluid channel 20. The barrier may be shaped in a way such that the folded portion 30 of the container arches upward when in the unfolded position, in order to provide a better seal.

The fluid channel 20 may have a width of, for example, between 5 mm and 20 mm, preferably between 10 mm and 15 mm, such as about 12 mm. However, the fluid channel may have any desirable width, depending on the application of the container.

When the interior volume 15 of the flexible container 14 is filled with product, the first flexible film 11 and the second flexible film 12 are spaced apart from each other within the flexible container 14. The separation of the first flexible film 11 and the second flexible film 12 creates folds across the at least one valve-like passageway 25. As shown in FIGS. 2 and 3, fold lines 26, 27 and 28 are present across from the valve-like passageways on each side of the barrier 24. The folds extend along the axes marked by dashed lines 26, 27 and 28. It should be understood, however, that the fold lines 26, 27, and 28 are representative of the approximate axes of the actual folds in the self-sealing valve, but they may not be clearly visible from the surface of the package. For example, the fold lines are likely not seen along the folded portion 30 when the portions of flexible films 11 and 12 that make up the folded portion of the package are separated, as shown in FIGS. 4-7.

The folds 26, 27, and 28, as well as the generally elongate barrier 24 extending across the fluid channel 20 opening cause a portion of the periphery of the package 80 comprising the folded portion 30 to curve inward (arch). The arching of the zone between the folds, that includes the fluid channel 20, has the effect of pressing the two flexible films 11 and 12 in this zone against each other, thus forming a self-sealing valve 23 that blocks the flow of the liquid through the valve-like passages 25 and through the fluid channel 20.

When the package is placed on a flat surface and a vertical force is applied approximately on the large central portion of the flexible container 14 in the center of the front and back package walls, then the folds 26, 27, and 28 and the arching effect of the zone between the folds that includes the fluid passage 20, tends to become more pronounced, thus increasing the effectiveness of the self-sealing valve 23.

Such accentuation of the folds close to the valve-like passages 25 as well as the increase in the arching of the zone between the folds with the application of a force essentially perpendicular to the plane of the flexible walls of the package, effectively prevents liquid leakages when the flexible receptacle is placed in its natural position on an essentially flat surface. Even when another object is placed on the top of the flexible container 14 or moderate pressure is applied to the center of the package 10 by a user, increasing the pressure in the interior volume 15, the self-sealing valve 23 maintains its integrity. Such a mechanism is extremely helpful in preventing accidental spillage.

In order to allow the flow of liquid through the valve-like passages 25 and through the fluid channel 20 and outlet 21, it is sufficient that a user applies a certain pressure to the flexible container, in particular by squeezing it, at least in part, in a direction essentially perpendicular to the plane of the barrier 24, thus partially opening the lips which close off the valve-like passages 25. Such a squeezing action is shown in FIG. 7. The release of this squeezing action re-closes the shrunken passages 25 and re-closes the package 10. Essentially, in order to eject the liquid product 16 from the interior volume, the user needs to squeeze the container from the sides, and when the user removes pressure from the sides, the package re-closes.

The squeezing of the receptacle from the sides, essentially perpendicular to the plane of the barrier, has the effect of reducing the arching and the folds, while at the same time increasing the pressure of the liquid in the container, which then causes the lips of the flexible sheets at the entrance of the valve-like passages 25 to partially open, allowing the liquid to flow out.

As shown in FIGS. 2 and 3, the package 10 contains a folded portion 30. In one embodiment, the corner 31 of the package contained by the folded corner 30 forms an acute angle. For example, the corner 31 of the package may form an angle between about 60° and about 88°. The angle of corner 31 is defined as the angle between the top edge 51 of the package and the portion of side edge 52 of the package, shown in FIGS. 2 and 3, which lies on folded portion 30, as shown in FIGS. 1-7. Such an angled corner allows for the optimum direction of the forces pertaining to the folding and unfolding of the folds 26, 27, and 28 and the arching of the zone between folds leading to a higher integrity seal when lying flat in its natural position, and better flow when squeezed from the sides.

The advantages to the described and depicted self-sealing valve 23 are that it is extremely simple to form and the operation of the valve is less dependent on the properties of the fluid and the elasticity of the material constituting the package than in other types of flexible containers.

Figure 4:
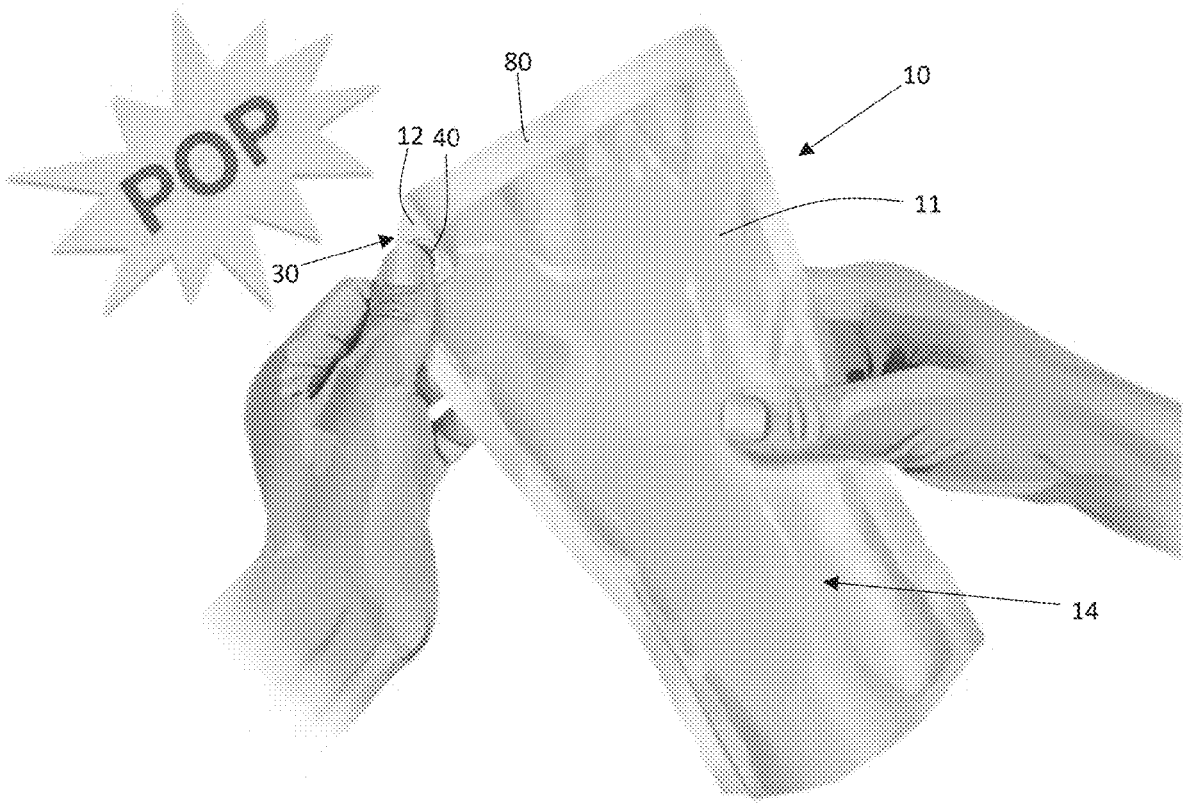
FIG. 4 shows one embodiment of the package with a user applying pressure to the breachable bubble.

In another embodiment, shown in FIG. 4, the barrier is located opposite the second end 22 of the fluid channel 20 as in FIG. 3, except that the barrier is in two parts, shown as 24 and 24', and has with a central passage 29. In this embodiment, the central passage 29 created between the barriers allows the flow of the liquid in the fluid channel 20 to be increased when the user applies pressure to the container in a direction essentially perpendicular to the plane of the barrier 24, as previously described.

As mentioned, and as shown in FIGS. 1-7, the package 10 generally contains a folded portion 30. The folded portion 30 is a portion of the package periphery 80 and contains a portion of the fluid channel 20 and the breachable bubble 40. The folded portion 30 may be in a folded position or in an unfolded position. FIG. 1 shows the folded portion 30 in the folded position. When the folded portion is in the folded position, the folded portion 30 lies against an exterior surface of the flexible container 14 so that the corner 31 of the folded portion 30 is in contact with or substantially in contact with one of the first flexible film 11 or the second flexible film 12.

The folded portion 30 is defined between a fold line 50, best shown in FIGS. 2 and 3 (shown in the unfolded position), the top edge 51 of the package, and the side edge 52 of the package, including the corner 31 of the folded portion 30. For example, the fold line 50 may generally be a crease in the first film 11 and/or the second film 12 caused by folding the first film 11 and the second film 12. In one embodiment, the first film 11 and/or the second film 12 can be scored along the fold line prior to forming the folded portion. The score line can assist in folding the corner of the package and to ensure that the folding is done at the proper location. The fold line 50 intersects the fluid channel 20 so as to block the flow of fluid through the fluid channel 20 when the folded portion 30 is in the folded position. Generally, the fold line 50 forms an obtuse angle in relation to the top edge 51 of the periphery 80 of the package. The angle may be between about 95° and about 160°, such as from about 110° to about 140°.

Optionally, a part of the folded portion 30 in contact with an exterior surface of the flexible container 14 may be adhered to the exterior surface using an adhesive. An adhesive layer may releasably secure the portion of the folded portion to an exterior wall of the container comprising either first flexible film 11 or second flexible film 12 when the folded portion is in the folded position as shown in FIG. 1. The adhesive layer may be any adhesive layer, substance or compound that can provide a bond between the folded portion and the exterior of the package, and that can release the various portions of the folded portion 30 from the exterior wall of the package upon manipulation of the folded portion 30 by a user. For example, in exemplary embodiments, the adhesive layer may be a hot melt adhesive. A user may, before, during or after the application of pressure to the folded portion 30, rub the folded portion 30 between the user's fingers. In exemplary embodiments, this slight manipulation may be sufficient to break the bond of the adhesive layer and separate the folded portion from the exterior of the package. Thus, in exemplary embodiments, the user may advantageously break the bond of the adhesive layer using only one hand. Alternatively, the user may pull or peel the corner 31 of the folded portion 30 from the exterior wall of the package, or may separate the folded portion from the exterior of the container using any known separation technique. It should be understood that the adhesive layer may be applied to the entire side of the folded portion 30 opposite the side that the breachable bubble 40 projects from, or to only parts of said side, such as by spot-application of the adhesive layer. Additionally or alternatively, a male and female fastener may be used to releasably secure the folded portion 30 of the package 10 to the exterior wall of the package.

It should be understood that the adhesive layer may, in some embodiments, remain on the various portions of the folded portion 30 after the bond of the adhesive layer is broken, and may thus be utilized to re-secure the folded portion to the exterior wall of the package. Thus, the user could, after opening the package 10 of the present disclosure as described herein, reseal the package 10 to save or store all or a portion of the product 16 contained in the interior volume 15 of the package 10 by moving folded portion 30 from the unfolded position to the folded position, thus reforming the releasable bond between the folded portion 30 and the exterior wall of the package comprising either first flexible film 11 or second flexible film 12.

As shown in FIGS. 2 and 3, the fluid channel 20 is sealed from the ambient by a breachable bubble 40. The breachable bubble 40 is surrounded by and defined by a bubble seal 41 that is at least partially breachable. For example, the bubble seal 41 can include a breachable point or portion 42 that is located opposite the fold line 50. The breachable point 42 represents a portion of the bubble seal 41 that more easily separates than the remainder of the seal.

The breachable bubble 40 is positioned on the folded portion 30 of the package and is in fluid communication with the fluid channel 20. In one embodiment, the bubble seal 41 circumscribes the fluid outlet 21 and the first end of the fluid channel 20. In this manner, when the folded portion 30 of the package is in the folded position, fluid cannot flow between the interior volume 15 of the package and the breachable bubble 40. However, when the folded portion 30 is in the unfolded position, fluid is allowed to flow between the breachable bubble 40 and the interior volume 15 of the package 10. As such, when the folded portion 30 is in the folded position, fluid may be trapped within the breachable bubble 40 such that the bubble seal 41 is configured to breach upon sufficient pressure applied by a user. Preferably, there is a weak spot 42 of the bubble seal 41 on the opposite side of the bubble from the fold line 50 so that the breachable bubble 40 bursts toward the corner 31 of the folded portion 30 allowing for unimpeded flow of liquid from the fluid channel 20 to the ambient. If the folded portion 30 is in the unfolded position, then the breachable bubble 40 is not configured to break upon pressure applied by a user as the fluid within the breachable bubble 40 would enter the interior volume 15 of the container instead of bursting the bubble seal 41.

In a preferred embodiment, the package 10 only contains a single breachable bubble. Additionally, it is preferable that the breachable bubble 40 only protrudes or projects from one side of the folded portion 30 of the package so as to not interfere with or be breached by the adherence of the folded portion 30 to the exterior of the flexible container 14. As such, the bubble preferably only projects from the side of the folded portion 30 opposite the exterior surface of the flexible container, when in the folded position.

The bubble seal 41 can be made using various techniques and methods. For instance, the bubble seal 41 can be made using thermal bonding, ultrasonic bonding, or an adhesive. For instance, in one particular embodiment, the bubble seal 41 can be made by placing a heated sealing bar against the outer periphery of the bubble and exerting heat and pressure so as to form the breachable bubble 40. In this embodiment, for instance, the breachable bubble 40 can be made from polymer films.

The breachable point 42 of the bubble seal 41 can also be made using different techniques and methods. When using a sealing bar to form the bubble seal 41, for instance, the breachable point 42 can be constructed by varying the pressure, varying the temperature, or varying the time in which the sealing bar is contacted with the materials along the portion of the bubble seal where the breachable point 42 is to exist.

Figure 5:
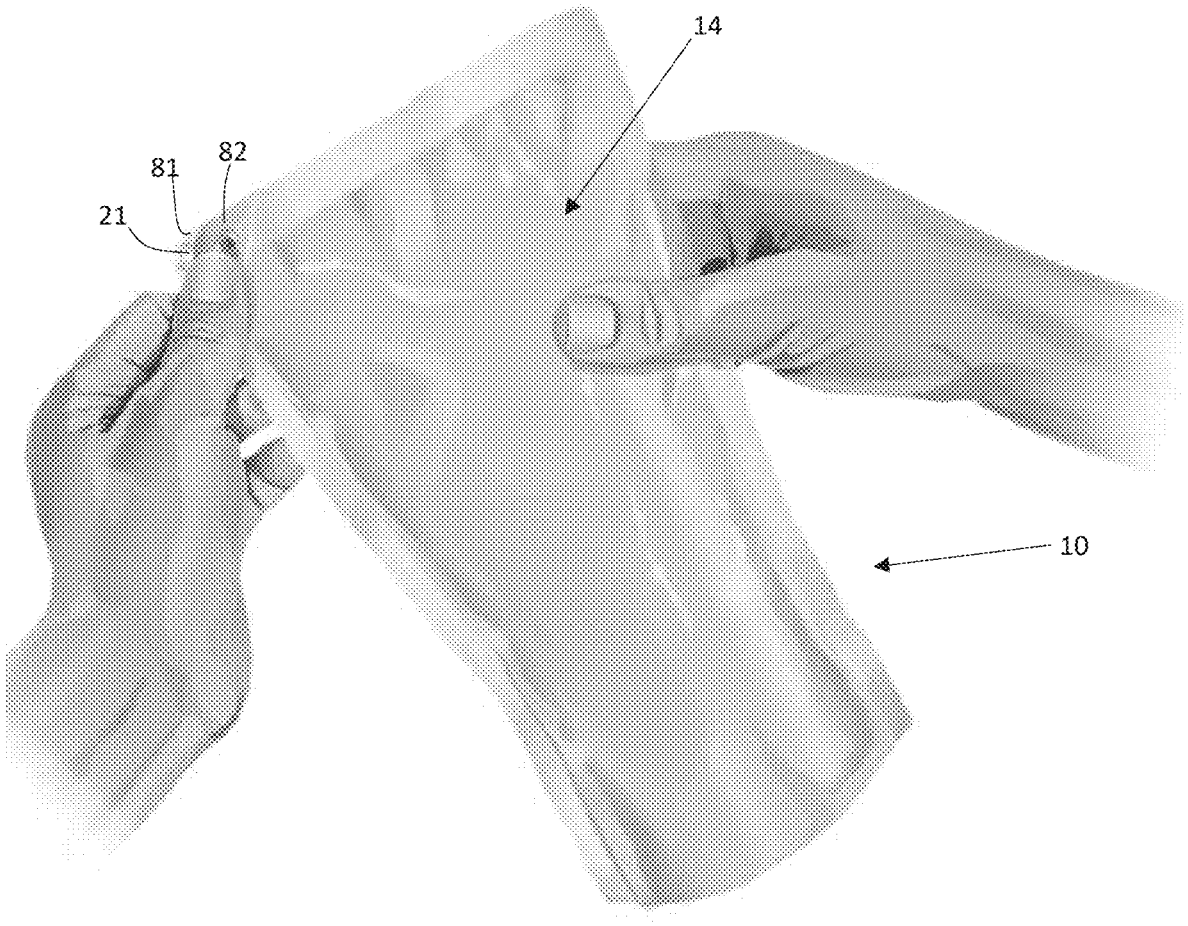
FIG. 5 shows one embodiment of the package after a user has breached the breachable bubble is unfolding the folded portion.
Figure 6:
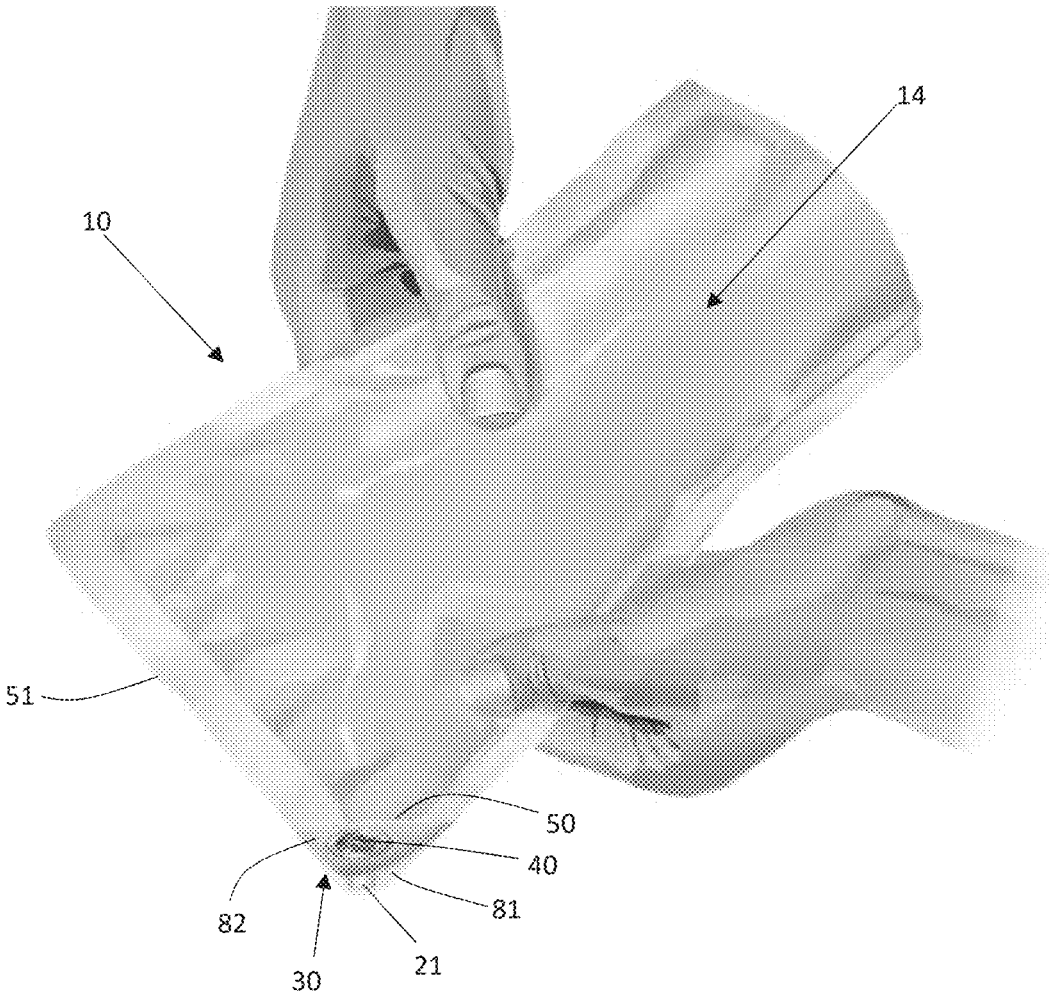
FIG. 6 shows one embodiment of the package after a user has breached the breachable bubble and has unfolded the folded portion.

In an alternative embodiment, the bubble seal 41 can comprise a heat sealed portion. The breachable point 42, on the other hand, may comprise a "peel seal" portion. In this embodiment, for instance, when the breachable bubble 40 is breached along the breachable point 42, a small opening may be formed along the bubble seal 41. The breached portion of the bubble seal can form two tabs that can be grasped by a user for further breaching the breachable bubble 40. In this manner, the opening of the bubble can be increased in size to a user's preference. An example of tabs formed by the breaching of the breachable bubble is shown in FIGS. 5-7. The tabs are marked by numerals 81 and 82.

Various different methods and techniques are used to form peel seal portions. For example, in one embodiment, the breachable point 42 of the bubble seal 41 may include a first portion that is adhesively secured to a second portion along the seal. The first portion of the breachable point may be coated with a pressure sensitive adhesive. The adhesive may comprise, for instance, any suitable adhesive, such as an acrylate.

The second and opposing portion of the peel seal, on the other hand, may comprise a film coated or laminated to a release layer. The release layer may comprise, for instance, a silicone.

When using an adhesive layer opposite a release layer as described above, the breachable point 42 of the bubble seal 41 is resealable after the bubble is breached.

In an alternative embodiment, each opposing portion of the breachable point 42 of the bubble seal 41 may comprise a multi-layered film. The major layers of the film may comprise a supporting layer, a pressure sensitive adhesive component, and a thin contact layer. In this embodiment, the two portions of the breachable point 42 can be brought together and attached. For instance, the thin contact layer of one portion can be attached to the thin contact layer of the opposing portion using heat and/or pressure. When the breachable bubble 40 is breached, and the breachable point 42 of the bubble seal 41 is peeled apart, a part of the sealed area of one of the contact layers tears away from its pressure sensitive adhesive component and remains adhered to the opposing contact layer. Thereafter, resealing can be affected by re-engaging this torn away contact portion with the pressure sensitive adhesive from which it was separated when the layers were peeled apart.

In this embodiment, the contact layer can comprise a film having a relatively low tensile strength and having a relatively low elongation at break. Examples of such materials include polyolefins such as polyethylenes, copolymers of ethylene and ethylenically unsaturated comonomers, copolymers of an olefin and an ethylenically unsaturated monocarboxylic acid, and the like. The pressure sensitive adhesive contained within the layers, on the other hand, may be of the hot-melt variety or otherwise responsive to heat and/or pressure.

In still another embodiment, the breachable point 42 of the bubble seal 41 can include a combination of heat sealing and adhesive sealing. For instance, in one embodiment, the breachable point 42 may comprise a first portion that is heat sealed to a second portion. Along the breachable point, however, may also exist a peel seal composition that may, in one embodiment, interfere with the heat sealing process of the bubble seal to produce a breachable portion. The peel seal composition, for instance, may comprise a lacquer that forms a weak portion along the bubble seal.

In an alternative embodiment, an adhesive may be spot coated over the length of the breachable point. Once the breachable point is breached, the adhesive can then be used to reseal the two portions together after use.

In embodiments where the breachable bubble is re-sealable, the package may be re-closed to provide a more robust seal than by relying on the self-sealing valve alone.

The breachable bubble 40 is filled with a gas, such as air. As shown in FIGS. 2 and 3, the interior volume of the breachable bubble 40 is generally in fluid communication with the fluid channel 20. The gas pressure within the bubble can be sufficient so as to prevent the contents of the container from exiting through the fluid channel 20 until the breachable bubble 40 is breached. As such, prior to breaching of the breachable bubble, the fluid within the interior volume of the container is prevented from escaping into the breachable bubble by both the self-sealing valve 23 and the gas pressure within the bubble. It is additionally prevented from escaping into the ambient by the bubble seal 42.

The breachable bubble 40, as described above, is expandable to open the package 10 by external pressure applied by a consumer. For small bubbles, the consumer may simply pinch a bubble or bubbles between his thumb and forefinger. Slightly larger bubbles may require thumb-to-thumb pressure. Pressure can also be applied to the bubble by placing the bubble against a flat surface and applying pressure with one's fingers or palm.

When pressure is applied to the breachable bubble 40, the atmosphere within the bubble applies pressure to the bubble seal 41 which causes the bubble to breach at the weakest portion. For instance, in embodiments that include a breachable point 42, separation of the bubble occurs along the breachable point 42 creating an edge breach. The edge breach may be sufficient to allow access to the fluid channel 20 for dispensing the contents of the container. Alternatively, the edge breach may form flaps 81 and 82 that can be easily peeled apart for better exposing the fluid channel 20. FIGS. 5-7 show the breachable bubble 40 after it has been breached.

In the embodiments illustrated, the breachable bubble 40 has a circular shape. It should be understood, however, that the breachable bubble can have any suitable shape. For example, in other embodiments, the breachable bubble may have an oval shape, may be triangular, may have a heart-like shape, may have a rectangular-like shape, or may have a more complex configuration.

It should be understood that containers made according to the present disclosure can have any suitable shape and configuration.

A method for opening the package is also disclosed. First, the package 10 is configured so that the folded portion 30 is in the folded position, cutting off fluid flow between the breachable bubble 40 and the interior volume 15 of the package. This is shown in FIG. 1.

Next, a user applies sufficient pressure to the breachable bubble 40 in order to breach the bubble seal 42 and separate first flexible film 11 from second flexible film 12. Preferably, the user applies pressure on the section of the bubble closest to the fold line 50. FIG. 4 shows a user applying pressure to and bursting the breachable bubble.

After the bubble is breached, the user unfolds the folded portion 30 from the folded position to the unfolded position, as shown in FIG. 5. This allows fluid communication between the ambient and the self-sealing valve 23. The user may have to further separate the two tabs 81 and 82 formed by the breaching of the bubble in order to expose the fluid outlet 21.

As shown in FIG. 6, once the folded portion 30 is in the unfolded position, the self-sealing valve 23 prevents unwanted fluid flow. For example, as the package 10 is opened and the folded portion 30 is unfolded, the self-sealing valve 23 prevents the contents of the interior volume 15 to escape. Further, even if the fluid channel 20 is pointed downward toward the ground, as shown in FIG. 6, the contents of the package are still unable to escape even if the user supplies a moderate amount of pressure to the center of the front and back walls of the package. This is due to the barrier 24 and the folds 26, 27, and 28 created by the self-sealing valve 23 and pressure, as described above.

When desired, in order to allow the liquid contained in the package 10 to pour out through the fluid channel 20 and fluid outlet 21, pressure is applied to the sides of the package perpendicular to the plane of the barrier 24, as shown in FIG. 7. The shape of the fluid channel 20 and fluid outlet 21 may be shaped in any manner in order to influence the flow properties as the fluid is poured out of the package. As such, the package allows for a precise, controlled flow, unlike many similar flexible liquid packages or pouches.

When the user wants to stop the flow of the liquid, they may simply stop applying pressure to the sides of the container and the self-sealing valve will close back up, preventing further flow. In this manner, the user does not need to reposition the container in an upright position in order to stop flow.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed:

1. A package comprising:

a flexible container defining an interior volume for receiving a liquid, the flexible container comprising opposing container walls, the container walls comprising a first film opposite a second film, the first film and the second film being sealed together to form the flexible container;

a fluid channel, the fluid channel including a first end and an opposite second end, the fluid channel being connected to the interior volume of the flexible container at the second end, the fluid channel having a width of between 5 mm and 20 mm from the first end to the second end;

a breachable bubble defining a breachable point located along a periphery of the package, the breachable point being in communication with the first end of the fluid channel and wherein the breachable bubble includes a bubble seal, the bubble seal having been formed between the first film and the second film of the flexible container, the breachable bubble extending over the fluid channel and around the first end of the fluid channel, the bubble seal between the first film and the second film being continuous except over the fluid channel such that the breachable bubble is in fluid communication with the fluid channel;

a self-sealing valve spaced from the second end of the fluid channel, the self-sealing valve comprising a barrier member formed by attaching together opposing container walls, the barrier member being located opposite the second end of the fluid channel in a manner that forms a first valve-like passageway and a second valve-like passageway between the second end of the fluid channel and the interior volume of the container, the barrier member being positioned and having a shape that causes the flexible container walls to prevent liquid flow through the first valve-like passageway and through the second valve-like passageway from the interior volume through the fluid channel absent external pressure, and wherein the barrier member of the self-sealing valve is traverse to the second end of the fluid channel;

wherein the breachable point breaches when pressure is applied to trapped air contained within the package to create a fluid outlet without tearing off a portion of the container, once created, the fluid outlet being in fluid communication with the interior volume of the flexible container through the fluid channel, and wherein fluids are dispensed from the interior volume through the self-sealing valve and fluid channel when pressure is applied to the interior volume of the flexible container; and wherein prior to breaching the breachable point, the breachable bubble is filled with a gas such that the gas pressure in the breachable bubble is sufficient to prevent fluids in the interior volume from exiting through the fluid channel.

2. A package as defined in claim 1, wherein the breachable bubble has a reclosable attachment such that the bubble can be reclosed after being breached.

3. A package as defined in claim 2, wherein the reclosable attachment comprises a pressure-sensitive adhesive.

4. A package as defined in claim 1, wherein the flexible container only includes a single breachable bubble.

5. A package as defined in claim 1, wherein the flexible container defines a top edge and wherein the breachable point is located along the top edge.

6. A package as defined in claim 5, wherein the breachable point is located at a corner of the top edge.

7. A package as defined in claim 1, wherein the breachable point comprising a weakened portion of the seal and wherein the breachable bubble breaches along the breachable point when sufficient pressure is applied to the bubble.

8. A package as defined in claim 1, wherein the barrier member has a length that extends beyond the second end of the fluid channel.

9. A package as defined in claim 1, wherein the flexible container includes a flowable product within the interior volume.

10. A package as defined in claim 1, wherein the flexible container is comprised of a flexible polymer film.

11. A package as defined in claim 1, wherein the flexible container contains a beverage within the interior volume.

12. A package as defined in claim 1, wherein the flexible container contains a gel, a cream, a paste, a syrup, a honey, an oil, a sauce, or an emulsion.

* * * * *